United States Patent [19]

Mashuda

[11] 3,964,786

[45] June 22, 1976

[54] MECHANIZED WHEELCHAIR

[76] Inventor: David Mashuda, R.D. No. 1, Evans City, Pa. 16033

[22] Filed: Dec. 20, 1974

[21] Appl. No.: 535,035

[52] U.S. Cl. ..... 297/330; 180/77 R; 180/DIG. 3; 280/DIG. 5; 280/242 WC; 297/70; 297/DIG. 10; 297/DIG. 4

[51] Int. Cl.[2] ..... A61G 5/04

[58] Field of Search ..... 180/77 R, DIG. 3; 280/DIG. 5; 297/DIG. 10, DIG. 4, 233, 234, 70, 330

[56] References Cited

UNITED STATES PATENTS

| | | | |
|---|---|---|---|
| 1,739,260 | 12/1929 | Roe | 297/DIG. 4 |
| 2,495,573 | 1/1950 | Duke | 180/DIG. 3 |
| 2,633,896 | 4/1953 | Thompson | 297/DIG. 4 |
| 2,770,289 | 11/1956 | McKendrey | 297/70 X |
| 3,023,048 | 2/1962 | Barton | 297/DIG. 10 |
| 3,191,990 | 6/1965 | Rugg | 297/DIG. 4 |
| 3,261,031 | 7/1966 | Gates | 297/DIG. 10 |
| 3,379,450 | 4/1968 | Jones et al. | 297/DIG. 10 |
| 3,406,772 | 10/1968 | Ahrent et al. | 297/DIG. 10 |
| 3,495,869 | 2/1970 | Ingemansson | 297/330 |
| 3,770,073 | 11/1973 | Meyer | 180/DIG. 3 X |

*Primary Examiner*—M. H. Wood, Jr.
*Assistant Examiner*—John P. Silverstrim
*Attorney, Agent, or Firm*—Buell, Blenko & Ziesenheim

[57] ABSTRACT

The specification discloses a wheelchair in which the seat, back and leg portions are so articulated and separately actuable, by power means, under control of the occupant, as to enable the occupant to assume any one of three positions, namely sitting, standing or reclining. Two separated leg support members are selectively actuable by the occupant to a horizontal leg-supporting position. Steering and forward and reverse propulsion controls accessible to the occupant are also provided, enabling the occupant to obtain substantially total mobility on level ground.

2 Claims, 5 Drawing Figures

Fig. I.

MECHANIZED WHEELCHAIR

It has long been known to provide wheel chairs, especially for invalids, mechanized to the extent of being convertible from a sitting posture to a reclining posture. In the simple forms of wheelchair the articulation of the seat, back and leg portions is such as to be manually adjustable by persons other than the occupant. In the more complex forms of wheelchair, power means is provided for actuating the parts under control of the occupant. Examples of wheelchairs of the latter type are disclosed in U.S. Pat. Nos. 2,694,437; 3,191,990; 3,284,126 and 3,495,869.

Wheelchairs of the above type are not suited for mobility, that is for propulsion by power means under the control of the occupant. However, wheelchairs having powered propulsion equipment subject to the control of the occupant of the wheelchair are known. For example, U.S. Pat. No. 3,111,181 discloses such a powered wheelchair in which the seat member and the back member are linked together in such manner as to lower the back member to a reclining position upon forward movement of the seat member, and vice versa.

None of the aforesaid types of wheelchairs, so far as is known, are completely suited for total mobility by the occupant. By total mobility is meant, in addition to conversion from sitting to reclining posture, and vice versa, and the powered propulsion of the wheelchair on level ground all under control of the occupant, the ability to so actuate the seat, back and leg portions under the control of the occupant as to raise the occupant to a standing posture from a sitting posture, or vice versa. In the case of some invalids, their ability to walk a short distance is contingent on the patient being raised to a standing posture. U.S. Pat. No. 2,295,006 discloses a wheelchair having a separable stretcher member capable of pivotal movement on the wheelchair by other than the occupant from a reclining to a standing position. However, the apparatus in the patent is not capable of providing total mobility to the patient or occupant of the wheelchair. U.S. Pat. No. 3,023,048 discloses a wheelchair with a seat member capable of being raised to assist the occupant to a standing position. In this patent, a hand pump, operable by the occupant supplies fluid under pressure to seat-actuating cylinders to effect the rise of the seat member.

None of the prior art patents, so far as can be determined, is capable of providing total mobility, as here defined, to the occupant of the wheelchair.

It is accordingly an object of my invention to provide a mechanized wheelchair which is capable of enabling an occupant to have total mobility, including the ability to rise to a standing posture from a sitting posture as well as to assume a full reclining position from a sitting posture.

More specifically I provide a mechanized wheelchair in which the seat, back and leg members are so linked and actuated, under the sole control of the occupant, as to enable the occupant to assume any one of three postures, namely sitting, standing or reclining.

I further provide a wheelchair for providing total mobility to the occupant in which two leg support members are so individually and separately actuable under the control of the occupant as to enable him, while in a sitting posture, to selectively actuate either one or both of the two leg support members to support one or both legs in an extended position.

Additional structural details of my improved wheelchair will be described hereinafter, in connection with the accompanying drawings, wherein.

Figure 1:
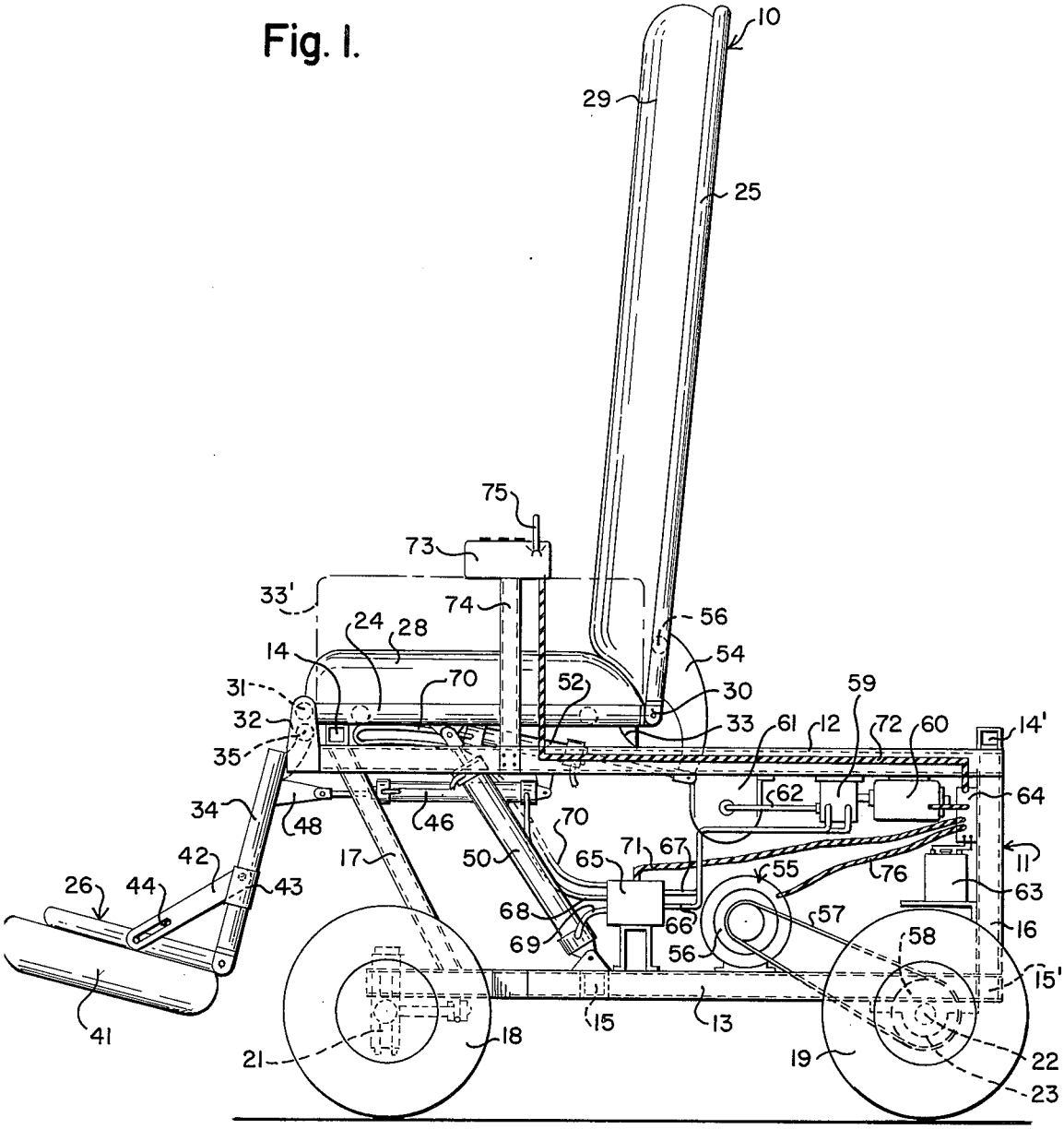
FIG. 1 is a side elevational view, showing an embodiment of my improved wheelchair while the parts are positioned in the sitting posture.
Figure 4:
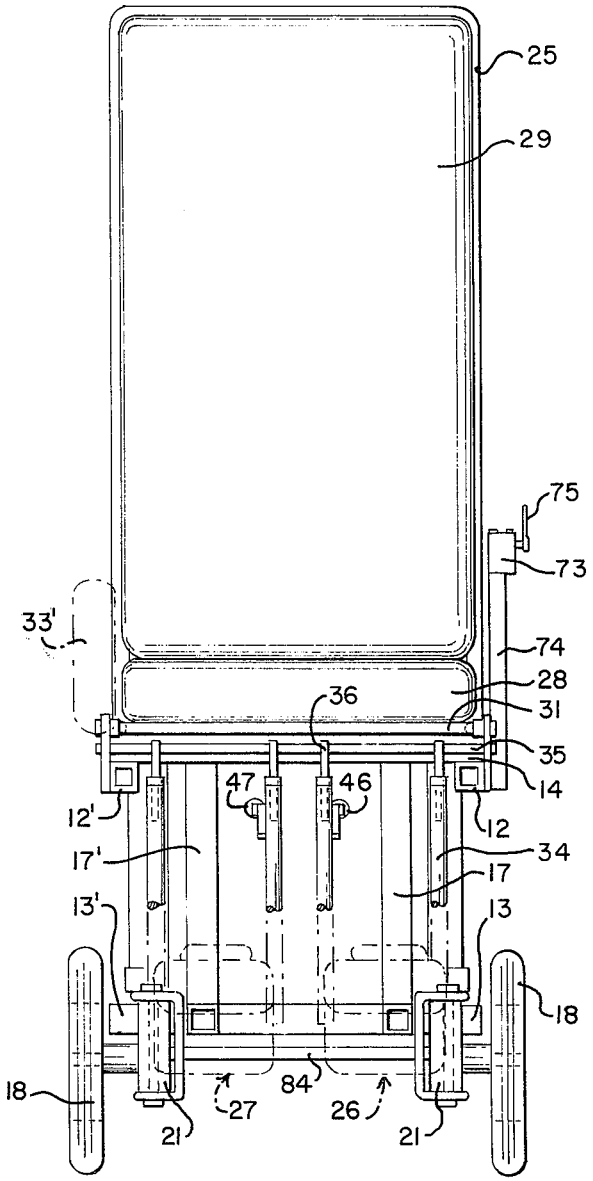
FIG. 4 is a skeletonized front view of the wheelchair of FIG. 1, showing the two separate leg support members and the manner of support thereof.
Figure 5:
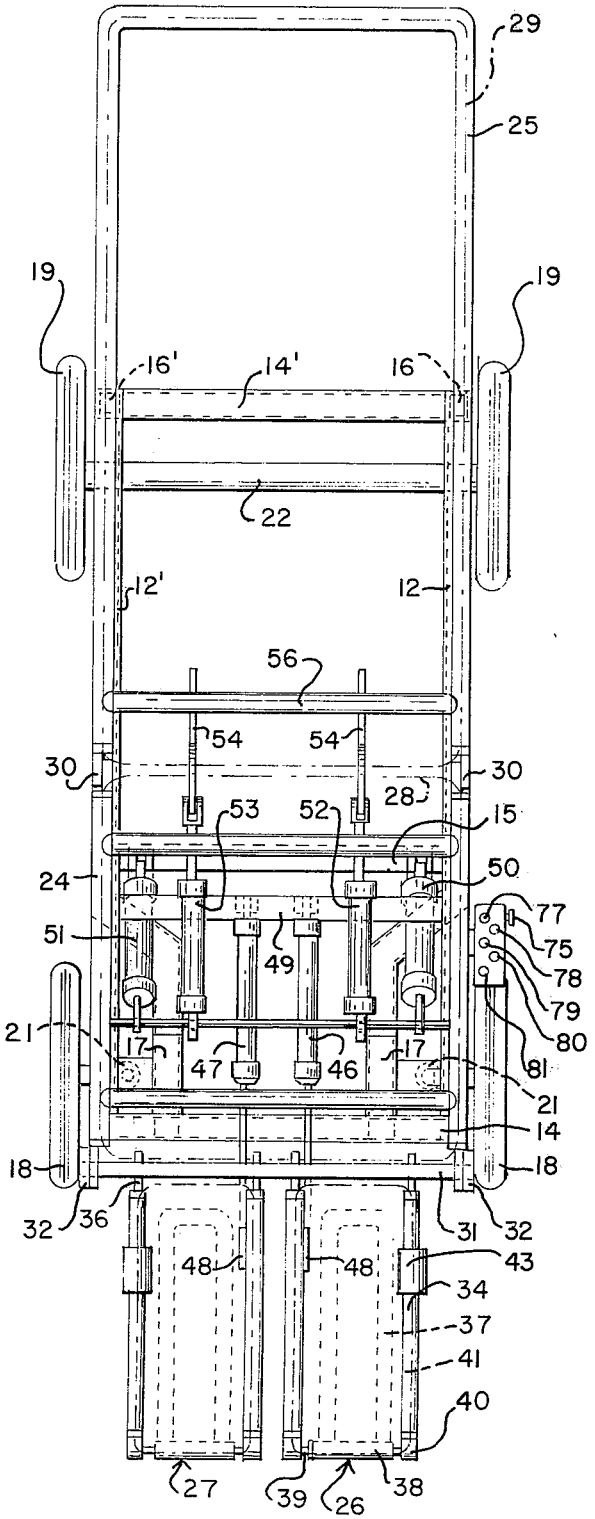
FIG. 5 is a skeletonized plan view of the wheelchair as shown in the reclining posture of FIG. 3.

Referring to the drawings, for example, FIGS. 1, 4 and 5, the wheelchair 10 comprises a body frame 11 made of structural steel girders, indicated as of square cross-section. The frame 11 comprises a pair of upper longitudinal girders 12 and 12' in parallel spaced relation, a pair of lower longitudinal girders 13 and 13' in parallel spaced relation, a pair of transverse girders 14 and 14' connecting the upper pair of girders 12 and 12', a pair of transverse girders 15 and 15' connecting the lower pair of girders 13 and 13', a rear pair of vertically spaced girders 16 and 16' connecting the upper pair of girders 12 and 12' and the lower pair of girders 13 and 13', and a front pair of forwardly inclined girders 17 and 17' connecting the upper and lower pairs of girders.

The frame 11 is supported on a pair of front wheels 18 and a pair of rear wheels 19. The front wheels are mounted for steering control by the occupant in well known manner, not shown in detail, except for king-pin support members 21. The rear wheels are mounted on a common axle 22, in turn supported in pillow-block type bearing 23, (FIG. 1) one of which is shown in outline, attached to the body frame 11.

The wheelchair 10 further comprises (FIG. 5) a rectangular seat frame 24 made of pipe, a rectangular back rest frame 25 of pipe, and a pair of rectangular leg members 26 and 27 also made of pipe. The pipe is preferably of light-weight metal, such as aluminum. Cushion members 28 and 29 are suitably attached to the corresponding seat and back rest frames 24 and 25. Suitable hinge fittings 30 secured in the juxtaposed ends of the pipe in the seat and back rest frames 24 and 25 are pivotally coupled together as by pins or rivets, thereby enabling relative hinged or swiveled movement between the back rest and seat frames.

The front end of the seat frame is swiveled, by means of hinge fittings, on a transverse rod 31, supported at its ends in bushings attached to vertically extending brackets 32 attached adjacent to the forward ends of the upper longitudinal girders 12 and 12'. The seat frame is supported in parallel spaced relation above the upper pair of girders 12 and 12' by a pair of lugs 33 (FIG. 1) that are attached or joined to the pipe frame members adjacent to the hinged joint coupling the seat frame and back rest frame together and which engage the upper surface of the girders 12 and 12'.

An arm rest member 33' shown by the chain line, may be provided in the form of a padded pipe frame attached to the side member of the seat frame 24 by suitable swivel connectors for support in various positions vertical, horizontal or inbetween. The outer end of arm rest member, while in a horizontal position, may rest on an adjacent bed to enable "log-rolling" a patient from chair to bed and vice versa.

The leg members 26 and 27 are similar in construction and accordingly only the member 26 will be described. The leg member 26 comprises a pair of pipe members 34 disposed in parallel spaced relation and hinged to a transverse rod 35 by hinge fittings 36 attached in the upper ends of the pipe members 34. The rod 35 extends in parallel relation to and below the rod 31, and is similarly supported at its respective ends in bushings attached to the brackets 32.

The leg member 26 further comprises a U-shaped frame 37 of pipe, the open end of which is closed by a pipe segment 38. The frame 37 is swiveled to the free ends of the pipe members 34, as by pins 39 engaging in bearings 40 at the free end of the pipe member 34. A cushion member 41 is suitably attached to the frame 37 in an inverted position when the leg member is down, as shown in FIG. 1.

Figure 3:
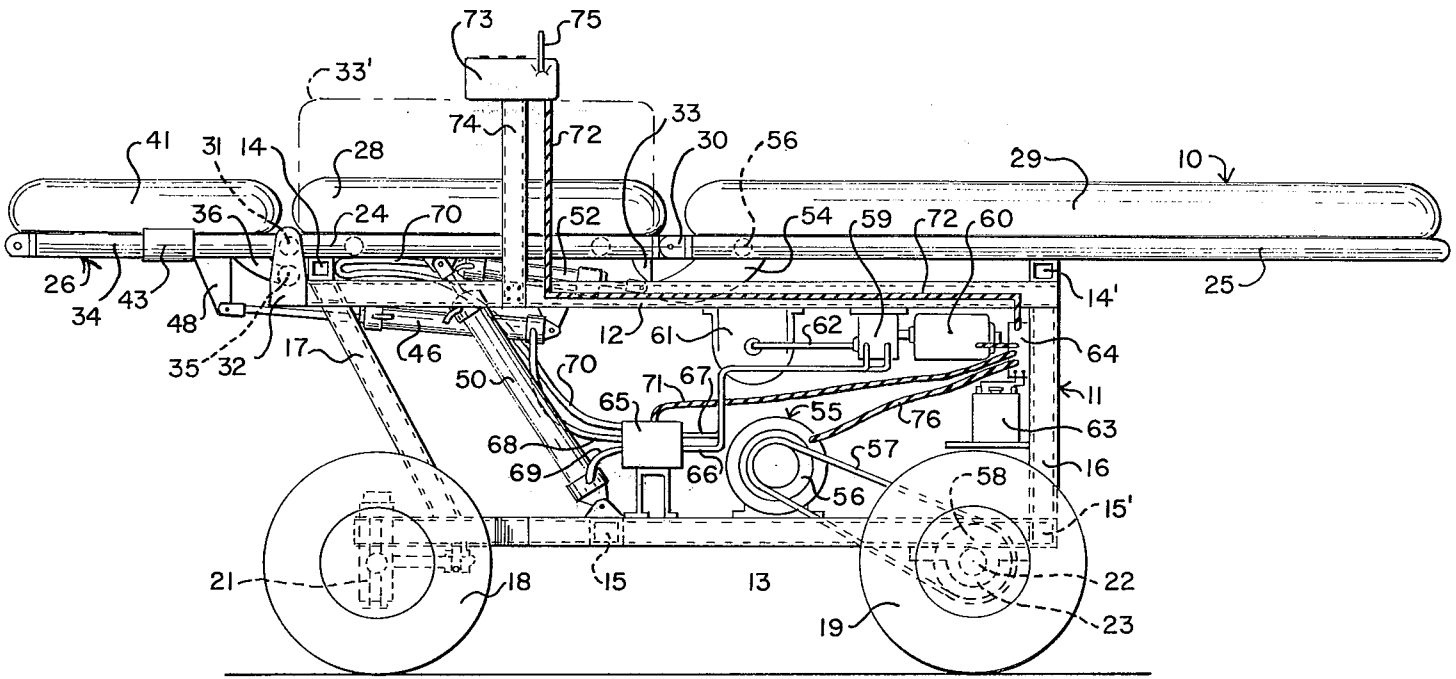
FIG. 3 is a side elevational view, showing the wheelchair of FIG. 1 while the parts are positioned for a reclining position of the occupant.

The frame 37 and attached cushion member 41 are restrained, in a position substantially at a right angle to the pipe members 34 to provide a foot rest on the reverse side of the cushion member 41, by a strut lever 42 (FIG. 1). Lever 42 is pivoted at one end on a pin attached to a sleeve 43 which slides on the one pipe member 34. Adjacent the opposite end of the lever 42 is a slot 44 through which a pin on frame 37 extends. It will thus be seen that when the cushion member 41 is pivoted up through approximately a right angle, the cushion member is in position to be swung face up into horizontal alignment with the seat cushion 28, as later to be described, and as shown in FIG. 3. Leg member 27 is similarly constructed and pivotally mounted.

Referring now to FIGS. 1 and 5 in particular, the fluid pressure motors, in the form of double acting hydraulic cylinders, by which the leg members 26 and 27, the seat frame 24, and the back rest frame 25 are actuated will now be described. It will be seen that individual cylinders 46 and 47 are provided for raising the leg members 26 and 27, respectively, from the down position in which they are shown in FIG. 1 to their raised position in horizontal alignment with the seat member cushion 28, in which they are shown in FIG. 3. Each cylinder has a piston rod with a clevis on the end by which to provide a pivotal connection to a bracket 48 on the inside pipe member 34 of each leg member.

The dead end of each cylinder 46, 47 is pivotally anchored as by a pin and clevis to a bracket on a cross strap 49 attached to the body frame. The reversal of pressure fluid at opposite ends of the cylinders 46 and 47 causes the cylinders to restore the leg members to a down position. As will be explained more fully later on, cylinders 46 and 47 may be individually controlled or simultaneously controlled under the control of the occupant of the wheelchair.

Figure 2:
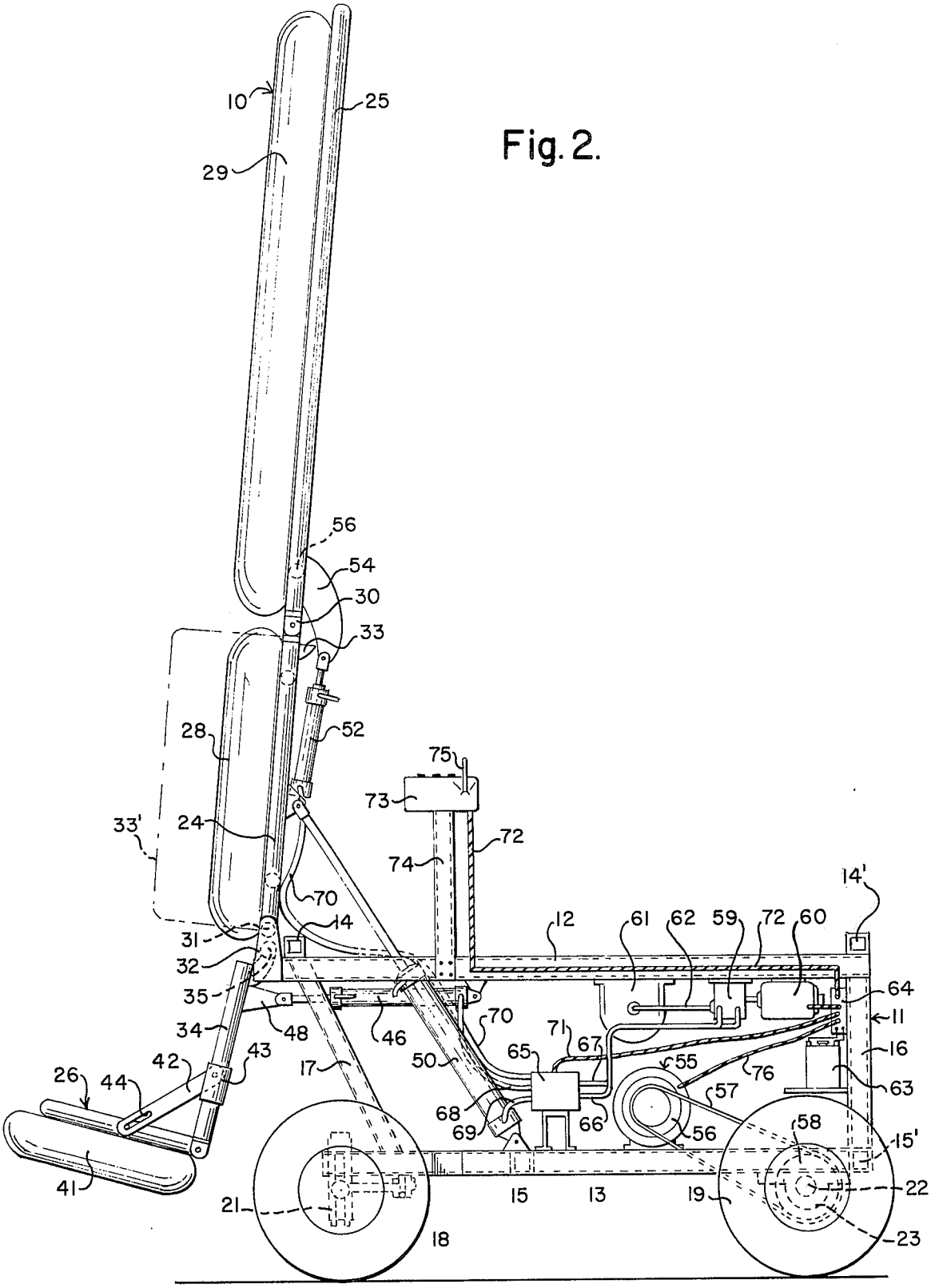
FIG. 2 is a side elevational view showing the wheelchair of FIG. 1 while the parts are positioned for a standing posture of the occupant.

The seat frame 24 is raised upwardly to the position shown in FIG. 2 for assisting the occupant to rise to a standing posture, by means of two cylinders 50 and 51, located on opposite sides of the wheelchair, in parallel relation to the longitudinal axis of the body frame, as seen in FIG. 5. The dead end of the cylinders is pivotally anchored, as by a pin and clevis connection, to the transverse girder 15 of the body frame 11. The distal end of the piston rod of each cylinder 50, 51 is pivotally connected as by a clevis and pin to the side members of the seat frame 24. The cylinders 50, 51 are arranged to be simultaneously pressurized, as more fully explained later on, to thereby extend their piston rods and raise the seat frame 24 and attached cushion 28 to the nearly vertical position shown in FIG. 2. On reversal of pressure fluid in the cylinders, each cylinder acts to restore the seat frame and cushion, to normal position in which it is shown in FIG. 1.

Actually, both the seat frame 24 and back rest frame 25 are raised and lowered together by reason of the pivotal connection therebetween. However, the back rest frame 25 is pivotally actuated, by two cylinders 52 and 53, from the position substantially at a right angle to the seat frame as viewed in FIG. 1, to a co-planar position in alignment with the seat frame 24, as viewed in either FIG. 2 or FIG. 3.

Cylinders 52 and 53 are pivotally anchored at their dead end, as by a clevis and pin connection (not shown) to the underside of the seat frame 24. The distal end of the piston rod of each cylinder 52 and 53 is pivotally connected, as by a clevis and pin connection, to the outer end of a corresponding curved bracket 54 which is suitably attached, as by welding, to a cross-strut 56 at the underside of the back rest frame 25. The two cylinders 52 and 53 are disposed in spaced relation parallel to each other and to the longitudinal axis of the body frame 11. Fluid under pressure, such as hydraulic fluid, is reversibly supplied to and released from both cylinders 52 and 53 simultaneously, under control of the occupant of the wheelchair, as will be described more fully later.

It will be seen that with fluid under pressure supplied to one end of both cylinders 52 and 53, the piston rods are extended, thus pivotally moving the back rest frame 25 and its cushion 29 to the upright position substantially at a right angle to the seat frame 24 and cushion 28 (FIG. 1). Similarly, upon reversal of pressure fluid in the cylinders 52 and 53, the cylinder swivels the back rest frame 25 and cushion 29 back to the co-planar position with respect to the seat frame member 24 (FIG. 3).

Thus far, the mechanical linkage and cooperative action of the leg, the seat and back rest members has been described. The apparatus for controlling propulsion of the wheelchair and controlling relative movement of the members whereby to enable the occupant to achieve complete and total personal mobility will now be briefly described. Since various types of equipment may be employed for the purpose, it will be understood that the equipment described herein is merely illustrative of any suitable equipment which may be employed for the purpose.

Referring to FIG. 1, a suitable electric motor 55 fixed to the body frame 11 drives the rear wheels 19 via a speed-reduction gear mechanism 56, and a drive chain 57 which engages a sprocket or gear wheel 58 on the common axle 22 of the rear wheels 19.

Also mounted on the body frame are the elements of a hydraulic pressure system comprising, a hydraulic pump 59, a motor 60 in direct-drive relation to the pump and a reservoir or tank 61 for hydraulic fluid connected to the pump 59 via a conduit 62. Further items of control equipment include a suitable battery 63, such as a 24 volt battery, a relay assembly 64, an electrically operated valve mechanism 65 which communicates with pump 59 via a pressure supply line 66 and a pressure release line 67. Valve mechanism 65 comprises a number of valves for respectively controlling the supply and release of hydraulic pressure fluid to and from each of the six cylinders 46, 47, 50, 51, 52 and 53. As shown in FIG. 1, a pair of conduits 68 (only one is shown) provides hydraulic communication between each of the two cylinders 46, 47 and the valve mechanism 65. Similarly a pair of conduits 69 (only one is shown) provides respective hydraulic communication between each of the two cylinders 50, 51 and the valve mechanism 65. Also a pair of conduits 70 (only one is shown) provides respective hydraulic communication between each of the two cylinders 52, 53 and the valve mechanism 65.

Suitable circuitry between the valve mechanism 65 and the relay assembly 64 is provided and shown as contained in single multiple-wire cable 71.

Relay assembly 64 is connected via a multi-wire cable 72 to a control device 73 mounted, for example, on a vertical strut 74 attached to a side member 12 of the body frame, and positioned for convenient access by the occupant of the wheelchair. If desired, the control device 73 may be separable from the strut 74 for convenience of control.

Control device 73 comprises a propulsion control device having a lever 75 which is shiftable from a central stop positon in opposite directions to a "forward" and "reverse" position. If desired, the propulsion control device may embody speed control means to enable the occupant to start the wheelchair moving at a slow speed and then increase the speed. It will be understood that motor 55 is connected by multi-wire cable 76 to the relay assembly 64, to which the battery 63 is also connected. Thus the electrical energy for motor 55 is supplied from battery 63 via the relay assembly 64.

The control device 73 further comprises a series of five two-position switches 77, 78, 79, 80 and 81, each having an operating lever or button accessible to the occupant.

Switch 77 is provided for energizing pump motor 60, via the relay assembly 64. The pump motor 60 in turn drives the pump 59 to build up hydraulic pressure in the system.

Switches 78 and 79 are provided for controlling corresponding magnet valves of valve mechanism 65, via relay assembly 64, to reversibly supply hydraulic pressure to and release pressure from the two cylinders 46 and 47 for raising and lowering the leg members 26 and 27.

Switches 80 and 81 similarly control corresponding magnet valves of valve mechanism 65, via relay assembly 64, to reversibly supply and release hydraulic pressure to and from the pairs of cylinders 50, 51 and 52, 53. Since the back-rest frame 25 and cushion 29 are maintained in a nearly vertical position by the fluid pressure supplied to one end of cylinders 52 and 53, it will be understood that the reversal of fluid pressure in cylinders 52 and 53 causes the back-rest frame 25 to be pivoted into coplanar relation with the seat frame 24 and cushion 28.

Pressurization of one end of cylinders 50, 51 causes the seat frame 24 and cushion 28 to pivotally rise into a nearly vertical position.

Thus, assuming the occupant of the wheelchair to be in a sitting posture represented by FIG. 1, if switches 80 and 81 are appropriately operated by the wheelchair occupant, the occupant will be raised into a standing position by reason of the seat and back portions of the wheelchair assuming their coplanar positions indicated in FIG. 2.

If the occupant of the wheelchair wishes to move from a sitting position to a reclining position, he operates switch 81 to first cause the back-rest frame 25 and attached cushion 29 to be actuated into co-planar relation with the seat frame 24. In addition, the occupant may selectively or simultaneously operate switches 78 and 79 to cause the leg members 26 and 27 to be separately or simultaneously raised into coplanar relation with the seat frame 24 and cushion 28, the latter position of the wheelchair being shown in FIG. 3. Of course, the wheelchair occupant, while in a setting position, may selectively operate either one or both of the switches 78 and 79 to raise one or both of the leg members 26 and 27 into partially or wholly raised position for supporting one or both legs in extended position, without operating switch 81 to pivot the back-rest frame 25 and cushion 29 to horizontal position.

It will be understood that while seated in the wheelchair, the occupant may cause movement of the wheelchair forwards or backwards while steering the front wheels 18 by means of a steering-rod (not shown) coupled to the tie-bar 84 (FIG. 4) transversely coupling the king-pin support bushings 21 of both front wheels 18.

Summarizing, it will be seen that the wheelchair occupant has total mobility, as herein defined. In addition to ability to cause movement of the wheelchair in any direction the occupant can (1) cause either or both leg members 26 and 27 to be partially or wholly raised so as to raise either or both legs to an angular or horizontal position, (2) cause seat and back frames to rise to a near vertical position to move the occupant to a standing position and (3) cause the leg members 26 and 27 and the back rest frame 25 to move into coplanar relation to the seat frame 24 and cushion 28 to enable the occupant to recline in a stretched-out horizontal position.

It will be understood that the wheelchair has been shown in the drawings and described herein for simplicity, as without enclosure for the body frame 11. However, it is intended that suitable covering members of sheet metal, plastic sheet, or laminated wood be suitably attached to the body frame members to effect enclosure thereof, both for appearance and for safety reasons.

I claim:

1. In a wheelchair of the type comprising a body frame supported on front and rear pairs of wheels, the improvement which comprises a pair of vertically extending brackets secured on each side of the body frame at the forward end thereof, a rectangular seat frame substantially shorter in length than said body frame the forward end of which is pivotally mounted on said pair of brackets and the rear end of which rests on the top of the body frame, said seat frame being swingable upwardly from said horizontal position through an arc to a position substantially at a right angle to the top of the body frame and vice versa, a back member having a substantially rectangular frame, means pivotally mounting one end of said back member frame to the free end of said seat frame, said back member being swingable with respect to said seat frame from a horizontal positon in which it is supported in coplanar relation to said seat frame by the top of said body frame through an arc to a position substantially at a right angle to said seat frame and vice versa, a pair of leg rest frame members, means pivotally mounting the upper ends of said leg rest frame members on said brackets for rotation on a common axis paralleling the axis of rotation of said seat frame, said leg rest frame members being swingable from a downwardly extending position at at substantial angle to the seat frame to a position in substantial coplanar relation thereto, one fluid pressure motor means having one end pivotally mounted on the body frame and connected at the other end to said seat frame for raising and lowering said seat frame and said back frame with respect to said body frame, a second fluid pressure motor means having one end pivotally mounted on the underside of said seat frame and having the other end connected to said back member for pivotally moving said back member between said coplanar position and said angular position with respect to the said seat frame and a third fluid pressure motor means having one end thereof pivotally mounted on the body frame and connected at the other end to said leg rest frame members for swinging said leg rest frame members from said downwardly extending positions thereof into the position in substantial coplanar relation to said seat frame and vice versa.

2. A wheelchair according to claim 1, wherein a bracket member is attached to said body frame and extends upwardly beside said seat frame, and control means is carried by said bracket member in a position accessible to the occupant of the wheelchair for selectively activating said several fluid pressure motor means to move said seat frame member, said back member and said leg rest members into different relative positions whereby to provide a sitting posture, a reclining posture and a standing posture for the occupant of the wheelchair.

* * * * *